US011808059B2

(12) United States Patent
Chen

(10) Patent No.: US 11,808,059 B2
(45) Date of Patent: Nov. 7, 2023

(54) LOCK FOR DOOR

(71) Applicant: Jeff Chen, Chiayi County (TW)

(72) Inventor: Jeff Chen, Chiayi County (TW)

( * ) Notice: Subject to any disclaimer, the term of this patent is extended or adjusted under 35 U.S.C. 154(b) by 230 days.

(21) Appl. No.: 17/226,026

(22) Filed: Apr. 8, 2021

(65) Prior Publication Data

US 2022/0162883 A1 May 26, 2022

(30) Foreign Application Priority Data

Nov. 23, 2020 (TW) ..... 109215408

(51) Int. Cl.
*E05B 47/00* (2006.01)

(52) U.S. Cl.
CPC .... *E05B 47/0012* (2013.01); *E05B 2047/002* (2013.01); *E05B 2047/0026* (2013.01)

(58) Field of Classification Search
CPC ..... E05B 47/0012; E05B 2047/002; E05B 2047/0022; E05B 2047/0026; E05B 2047/003; E05B 2047/0031; E05B 9/00; E05B 9/02; E05B 9/045; E05B 15/004; E05B 13/005; E05B 13/10; E05B 13/101; E05B 17/044; E05B 17/045; E05B 47/068; E05B 2047/0028; E05B 2047/0032; E05B 17/0054; E05B 17/046
USPC ..... 292/172, 142, 279
See application file for complete search history.

(56) References Cited

U.S. PATENT DOCUMENTS

2006/0131121 A1* 6/2006 Simm ..... B25B 21/00 192/54.5
2009/0211320 A1* 8/2009 Wu ..... E05B 47/0012 70/277
2010/0212381 A1* 8/2010 Huang ..... E05B 47/068 70/279.1

* cited by examiner

*Primary Examiner* — David R Hare
*Assistant Examiner* — Peter H Watson
(74) *Attorney, Agent, or Firm* — LAW OFFICE OF MICHAEL CHEN; Che Yang Chen

(57) ABSTRACT

A lock for door includes a locking latch assembly, a lock rotor, a lock bolt and a rotating member, wherein the latch includes an upper rotor member, a clutch transmission set, a deceleration gear set, and a motor. When the deceleration gear set is driven by the motor, the deceleration gear set immediately drives the clutch transmission set to move the lock bolt. When the lock rotor is manually driven to rotate and the upper rotor member is connected to rotate, the upper rotor member pushes the clutch transmission set for a clutch action, so that the clutch transmission set only drives the lock bolt to move so as to selectively lock and unlock the lock for door.

2 Claims, 12 Drawing Sheets

LOCK FOR DOOR

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

This present invention relates to a lock for door, and more particularly to a lock for door that is capable of converting electric mode to manual mode through a clutch mechanism.

Description of Related Arts

The lock mainly adapted to be installed to the door has various different patterns. A general door lock is designed for using a key to open or lock the door from outside while the interior configuration of the door is configured to lock or unlock the door in a rotation manner. In addition, a more advanced door lock is designed as electric mode. For example, the door lock is operated through a password or fingerprint from outside of the door, such as the technology embodied as electric mode door lock disclosed in the U.S. Pat. No. 10,364,594B2. However, in order to prevent the electric mode door lock from being unable to operate due to malfunction, it is necessary to additional provide a manual mode therefor at the same time. But, at present, the structure of converting between the electric mode and manual mode is so complex that it is not only difficult to be assembled, but also has a relatively higher manufacturing cost. Therefore, it is an objective of the present invention to provide a lock for door with simple structure that substantially reduces the manufacturing cost in view of the above drawbacks and deficiencies.

SUMMARY OF THE PRESENT INVENTION

An advantageous of the present invention is to provide a lock for door with simple structure and lower manufacturing cost.

Accordingly, a lock for door comprises an outer case, an inner case connected with the outer case by screwing, a locking latch assembly arranged between the inner case and the outer case, a lock rotor arranged between the out case and the locking latch assembly, a lock bolt configured to be linked with the locking latch assembly, and a rotating member pivotally provided in the inner case, wherein the locking latch assembly comprises a first latch shell, a second latch shell butted with the first latch shell, and a upper rotor member, a clutch transmission set, a deceleration gear set, and a motor arranged between the first latch shell and the second latch shell. The upper rotor member has a cylindrical shape and is pivotally arranged in the first latch shell. Two top butting elements are protrudedly formed on one end face thereof, a protruding wing is formed on each side thereof, a through hole is axially penetrated therethrough. The clutch transmission set comprises a linking gear pivotally sleeved on the upper rotor member, a clutch gear pivotally arranged on the second latch shell, and an resilient element arranged between the clutch gear and the second latch shell, wherein two first grooves are formed in opposite directions at an inner circular surface of the linking gear, and two second grooves are intervally formed in opposite directions at the inner linking gear in such a manner that each of the two first groove is positioned between two of said grooves correspondingly, wherein the first grooves are arranged for the corresponding protruding wings to engage therewith respectively while allowing the protruding wings to rotate for an appropriate angle. The clutch gear is arranged coaxially adjacent to the linking gear, wherein the inner circular surface of the clutch gear forms two opposing engaging grooves correspondingly and two opposing protruding lug elements integrally protruded on an end face of the linking gear, such that the engaging grooves are configured for the corresponding top butting elements being engaged therein respectively while the protruding lug elements are engaged in the two corresponding second grooves respectively, wherein each of the protruding lug elements is allowed to rotate at an appropriate angle in the corresponding second groove. The deceleration gear is meshed with the clutch gear and driven by the motor to rotate the clutch gear. The lock rotor comprises a key control member arranged in the outer case, and a rotary handle extended from the key control member, wherein the rotary handle is configured to be capable of passing through the through hole of the upper rotor member fittingly for driving the upper rotor member to rotate. The lock bolt comprises a rack meshed with the linking gear and a bolt lock body extended from the rack, wherein the rack can be driven by the linking gear to link the bolt lock part to slide with respect to the bolt case for selectively forming a locking or unlocking state.

When the deceleration gear set is driven by the motor, the deceleration gear set immediately drives the clutch gear to rotate. The clutch gear drives the linking gear to rotate by the protruding lug elements and then to move the rack and the bolt lock body. When the rotary handle is manually driven to rotate, the upper rotor member is rotated with the rotary handle, so that the top butting elements push the clutch gear for an axial displacement to compress the resilient element to cause the protruding lug elements detached and separated from the second grooves respectively, and that the upper rotor member continues to rotate, so that the protruding wings drive the linking gear to rotate and then move the rack and the bolt lock body. Accordingly, the lock for door can be switched smoothly between the electric mode and the manual mode according to the design of the clutch transmission set of the locking latch assembly. However, the construction of the components of the clutch transmission group is simple, which makes the overall structure of the door lock simple too. Therefore, the assembly is also relatively simple that saves material cost and assembling cost.

DETAILED DESCRIPTION OF THE PREFERRED EMBODIMENT

Figure 1:
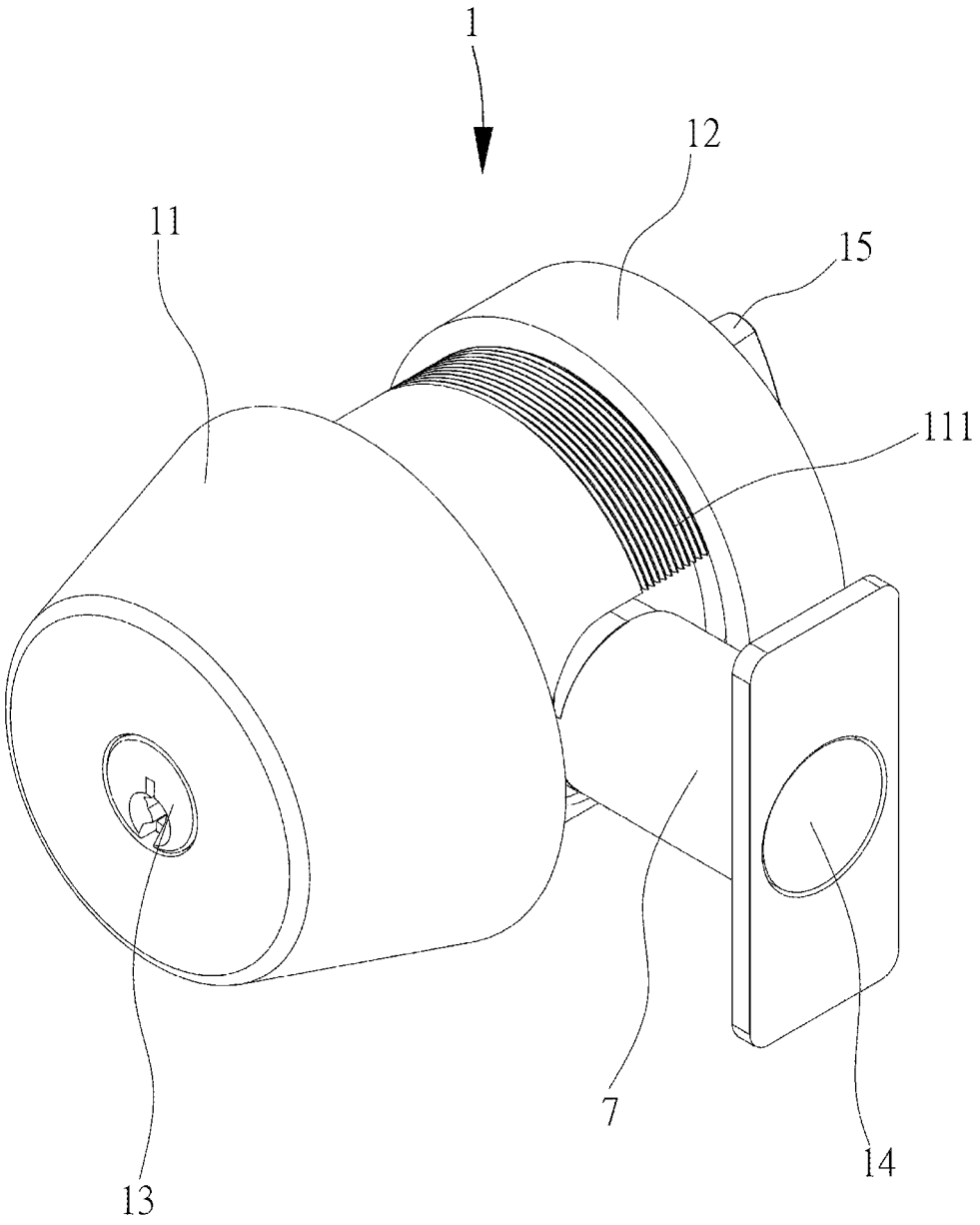
FIG. 1 is a is a perspective view of a lock for door according a preferred embodiment of the present invention.
Figure 2:
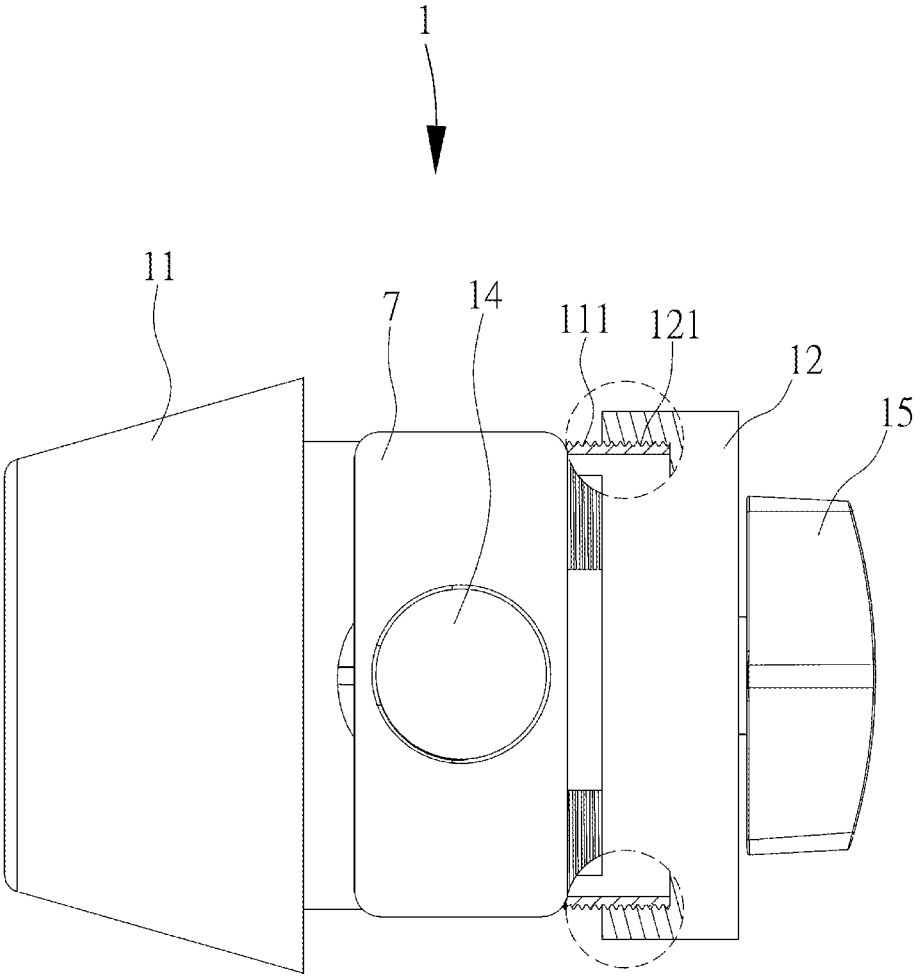
FIG. 2 is a partial section view of the lock for door according to the above preferred embodiment of the present invention.
Figure 3:
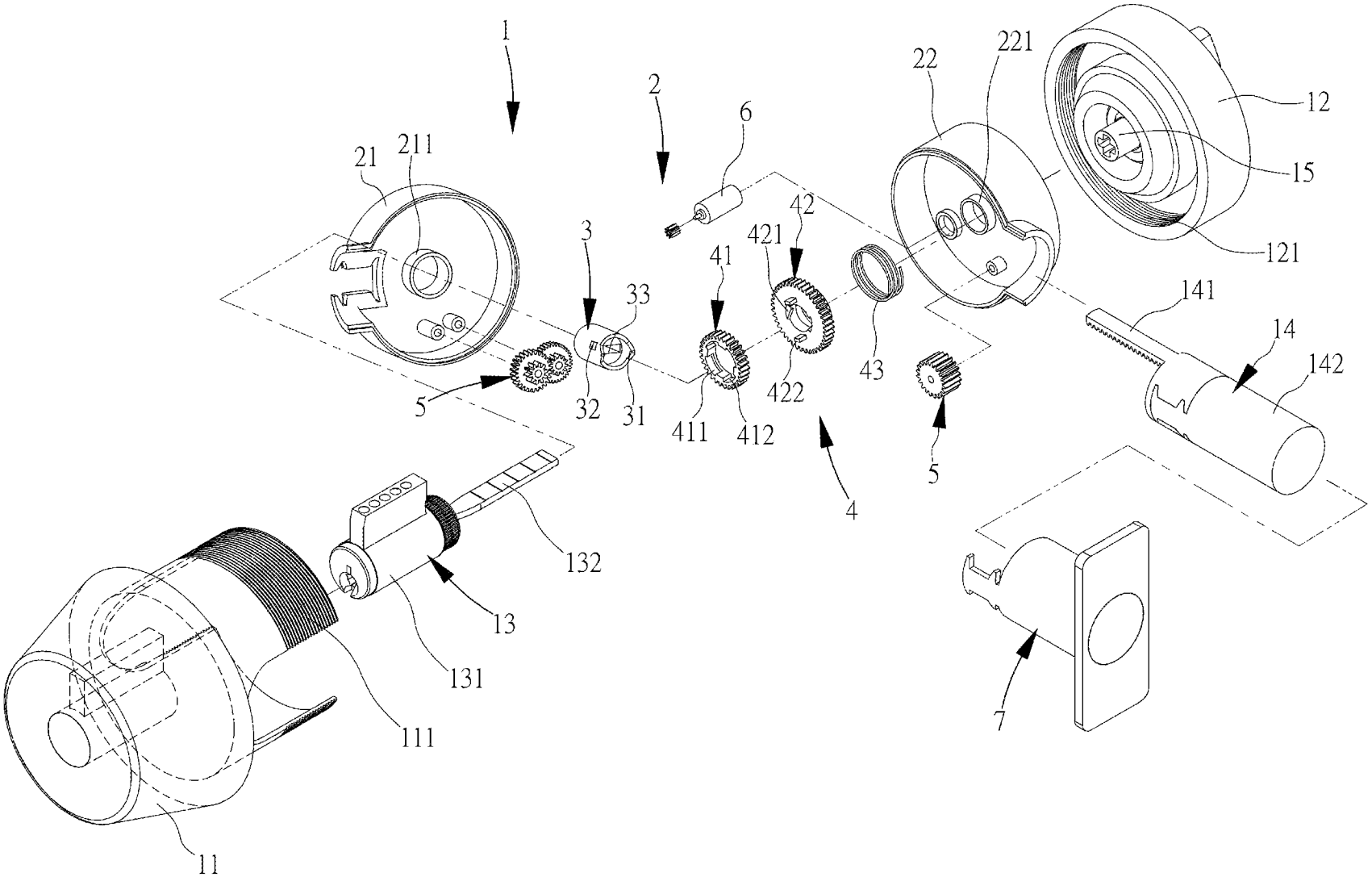
FIG. 3 is a exploded perspective view of the lock for door according to the above preferred embodiment of the present invention.
Figure 4:
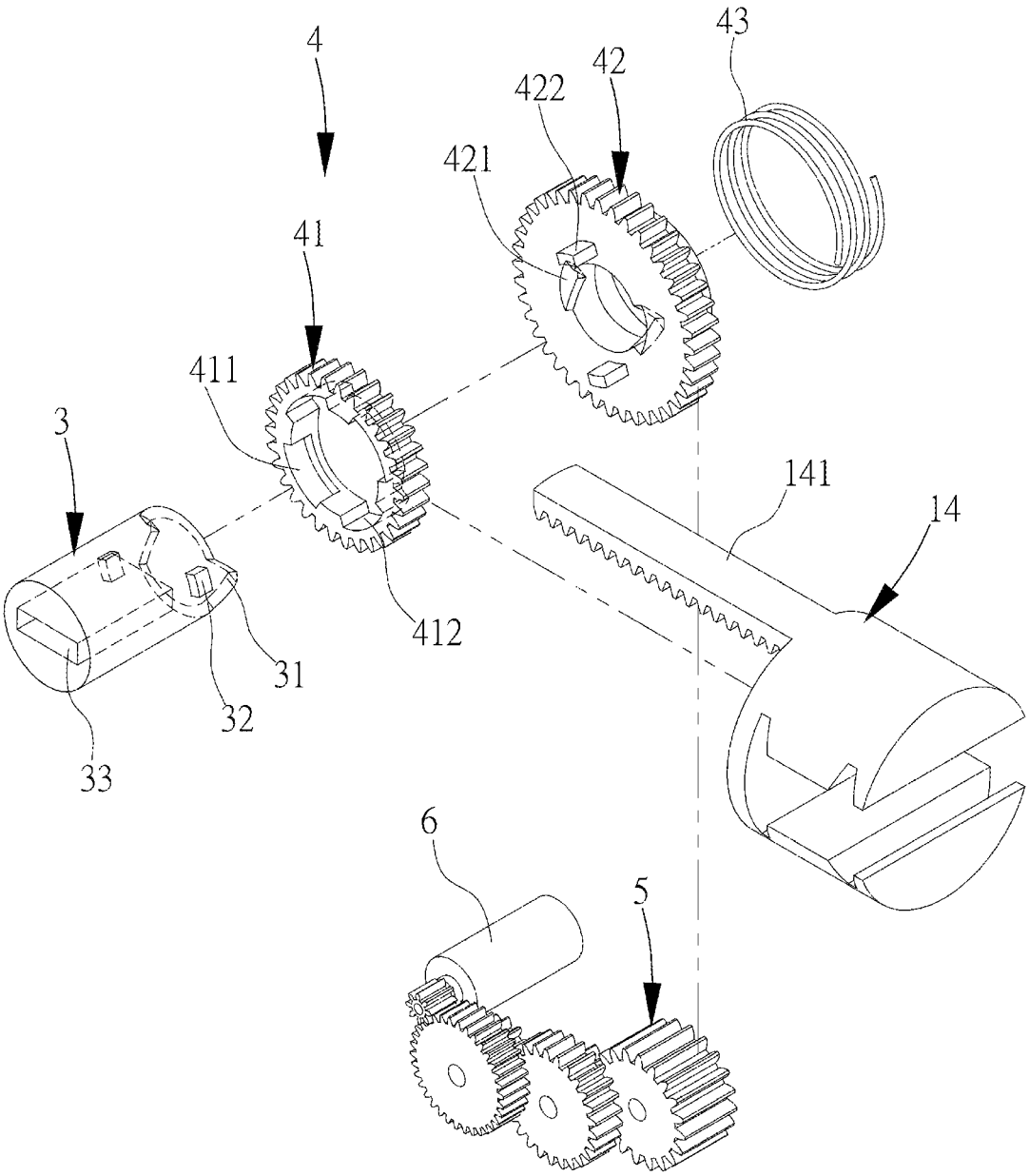
FIG. 4 is a exploded perspective view of the clutch transmission set, the deceleration gear set and the locking latch of the lock for lock according to the above preferred embodiment of the present invention.

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Referring to FIGS. 1 to 6, a lock for door according to a preferred embodiment of the present invention is illustrated, which can be locked or unlocked in either an electric mode or a manual mode. The lock for door comprises an outer case 11, an inner case 12 connected with the outer case 11 by screwing, a locking latch assembly 2 arranged between the inner case 12 and the outer case 11, a lock rotor 13 arranged between the outer case 11 and the locking latch assembly 2, a lock bolt 14 configured to be linked with the locking latch assembly 2, and a rotating member 15 pivotally provided in the inner case 12, wherein an outer threaded portion 111 is formed on the outer case 11 and an inner threaded portion 121 is formed on the inner case 12, such that the inner threaded portion 121 connected with the outer threaded portion 111 by screwing, so as to relatively assemble the outer case 11 with the inner case 12.

The locking latch assembly 2 comprises a first latch shell 21, a second latch shell 22 butted with the first latch shell 21, an upper rotor member 3 arranged between the first latch shell 21 and the second latch shell 22, a clutch transmission set 4, a deceleration gear set 5, and a motor 6. A hollow pivot ring 211 is formed at a central portion of the first latch shell 21, and a hollow receiving ring 221 is integrally formed at a central portion of the second latch shell 22. The upper rotor member 3 has a cylindrical shape and is pivotally arranged in the pivot ring 211 of the second latch shell 21, wherein two top butting elements 31 are protrudedly formed on one end face of the upper rotor member 3, a protruding wing 32 is formed on each side of the upper rotor member 3, and a through hole 33 is axially penetrated through the upper rotor member 3. The clutch transmission set 4 comprises a linking gear 41 pivotally sleeved on the upper rotor member 3, a clutch gear 42 pivotedly arranged on the receiving ring 221 of said second latch shell 22, and at least a resilient element 43 arranged to be sleeved on the receiving ring 221 and positioned between the clutch gear 42 and the second latch shell 22 for pressing against both the clutch gear 42 and the second latch shell 22. The linking gear 41 of the clutch transmission set 4 has two first grooves 411 intervally formed in opposite directions at an inner circular surface of the linking gear 41, and two second grooves 412 intervally formed in opposite directions at the inner circular surface of the linking gear 41 in such a manner that each of the two first grooves 411 is positioned between two of the second grooves 412 correspondingly, wherein the two first grooves 411 are arranged for the corresponding protruding wings 32 to engage therewith respectively, while allowing the two protruding wings 32 to rotate in the two first grooves 411 respectively for an appropriate angle. The clutch gear 42 is arranged coaxially adjacent to the linking gear 41, wherein the inner circular surface of the clutch gear 42 forms two opposing engaging grooves 421 correspondingly and two opposing protruding lug elements 422 integrally protruded on an end surface of the linking gear 41, such that the engaging grooves 421 are configured for the corresponding top butting elements 31 being engaged therein respectively while the two protruding lug elements 422 are engaged in the two corresponding second grooves 412 respectively, wherein each of the protruding lug elements 422 is allowed to rotate at an appropriate angle in the corresponding second groove 412. The deceleration gear set 5 adapted for engaging with the clutch gear 32 comprises a plurality of gears having different sizes, which are axially and rotatably arranged between the first latch shell 21 and the second latch shell 22 and driven by the motor 6 to rotate for driving the clutch gear 42 to rotate.

The lock rotor 13 comprises a key control member 131 arranged in the outer case 11, and a rotary handle 132 extended from the key control member 131, wherein the rotary handle 132 is configured to be capable of passing through the through hole 33 of the upper rotor member 3 fittingly for driving the upper rotor member 3 to rotate. Since the structural design between the key control member 131 and the rotary handle 132 is conventional technology (referring to the patent application Ser. No. 09/202,818 of the Republic of China) that is not repeatedly described here.

The lock bolt 14 is arranged inside a bolt case 7 by which the lock bolt is installed on the door. The lock bolt 14 and the bolt case 7 are inserted between the first latch shell 21 and the second latch shell 22 in a conventional configuration that is not repeated here. The lock bolt 14 comprises a rack 141 meshed with the linking gear 41 and a bolt lock body 142 extended from the rack 141, wherein the rack 141 can be driven by the linking gear 41 to link the bolt lock part 142 to slide with respect to the bolt case 7 for selectively forming a locking or unlocking state.

The rotating member 15 is connected with the rotary handle 132 through the receiving ring 221, such that when the rotating member 15 is rotated, the rotary handle 132 is able to be driven to rotate and thus linking the clutch transmission set 4 to move correspondingly. It is worth mentioning that, at this time, the rotary handle 132 can be rotated relatively to the key control member 131.

Figure 5:
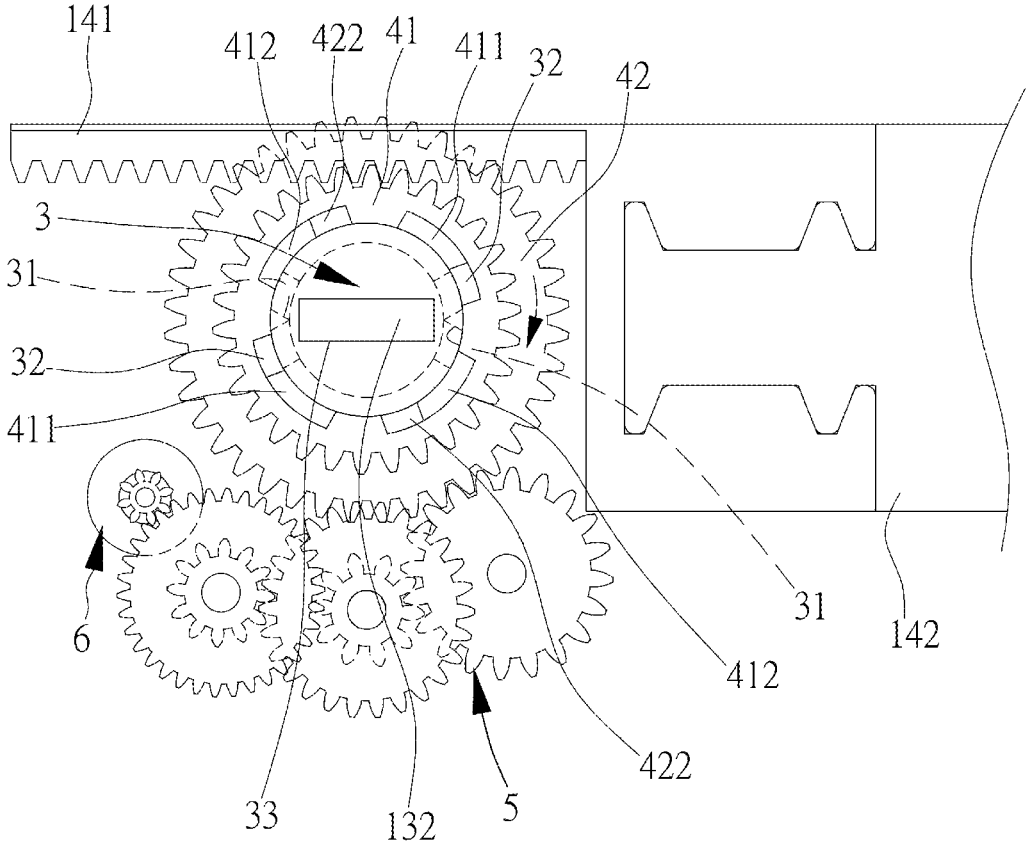
FIG. 5 is a front schematic view of the clutch transmission unit, the deceleration gear unit and the lock bolt of a door lock according to the above preferred embodiment of the present invention.
Figure 6:
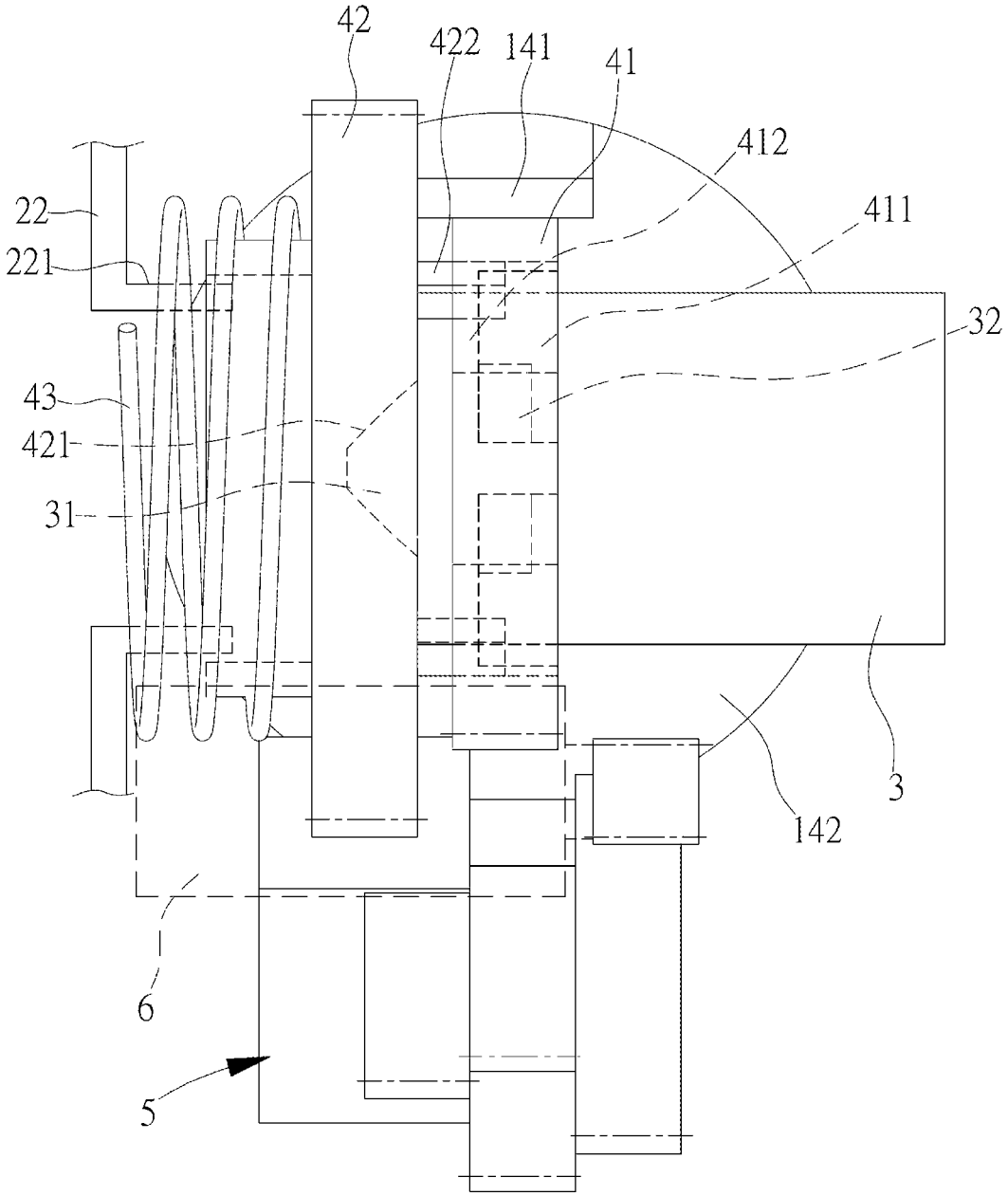
FIG. 6 is a side schematic view of FIG. 5.
Figure 7:
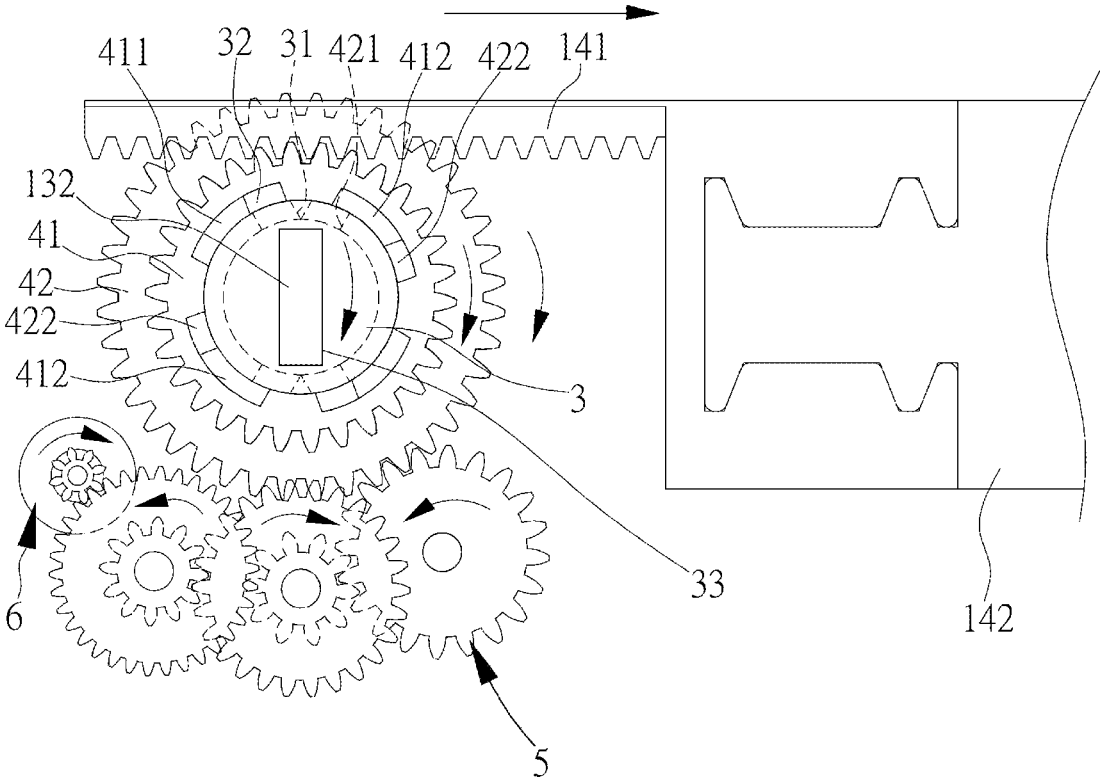
FIG. 7 is a continuous schematic view of FIG. 5.
Figure 8:
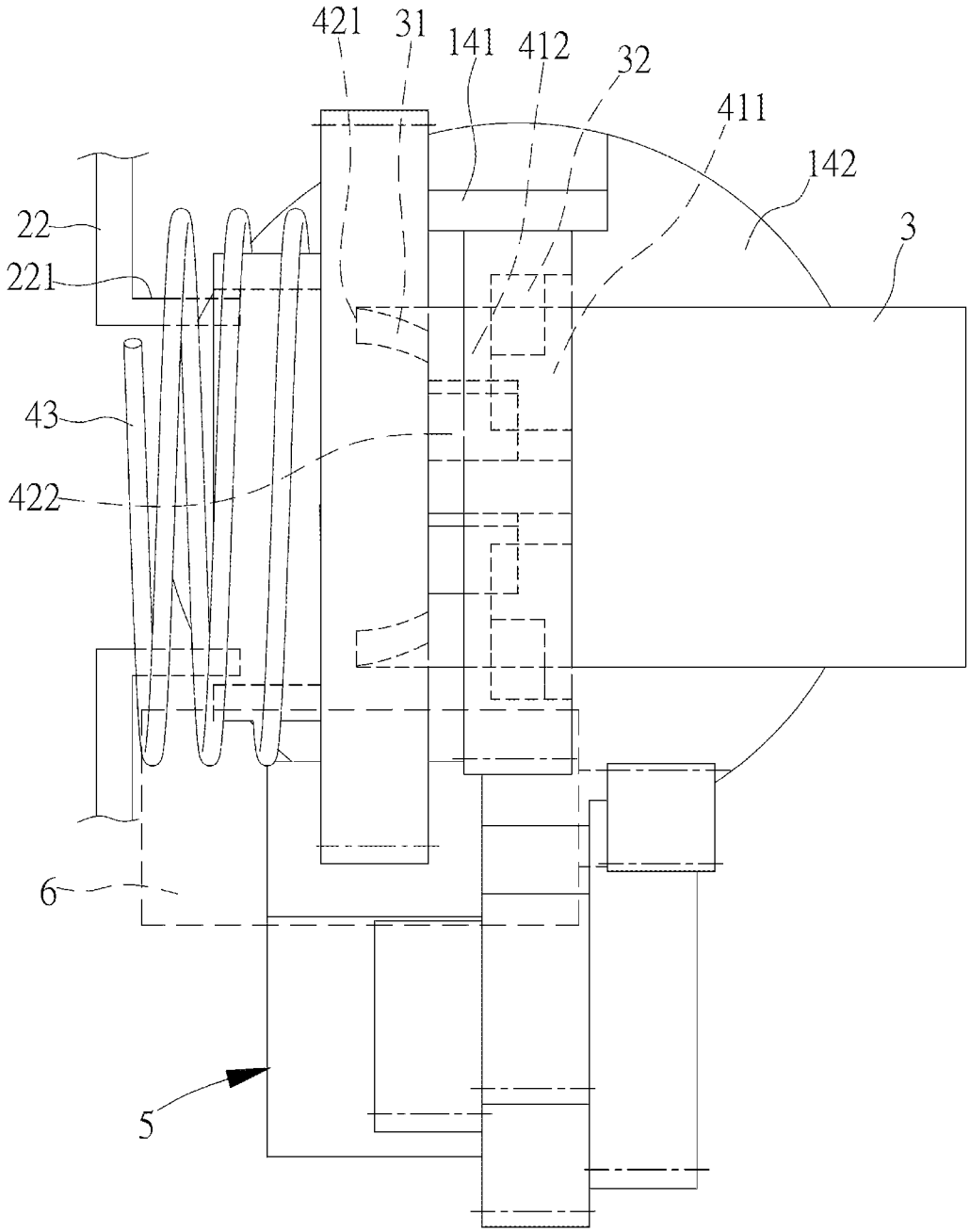
FIG. 8 is a side schematic view of FIG. 7.

An electrical actuation process of the lock 1 for a door comprises the following steps. Firstly, to lock in an electric mode under an unlocked state as shown in FIGS. 5 and 6, the motor 6 drives the clutch gear 42 to rotate through the deceleration gear set 5 for 90 degrees in a direction as shown by the arrow in FIG. 5 to a position as shown in FIG. 7 and FIG. 8. However, during the rotation of the clutch gear 42, the protruding wings 422 are inserted and engaged in the second grooves 412 respectively and thus the linkage gear 41 is driven to rotate at the same time that the rack 141 is linked to move to drive the bolt lock part 142 to be in a locked state, wherein when the clutch gear 42 rotates, the upper rotor member 3 is linked to rotate due to the engaging and interlocking of the engaging grooves 421 and the top butting elements 31, and that the rotating handle 132 and the rotating member 15 rotates accordingly at the same time. Thereafter, in order to electrically unlock the lock 1, simply actuate the motor 6 to drive the deceleration gear set 5 to rotate the clutch gear 42 and the linking gear 41 reversely in opposite direction.

Figure 9:
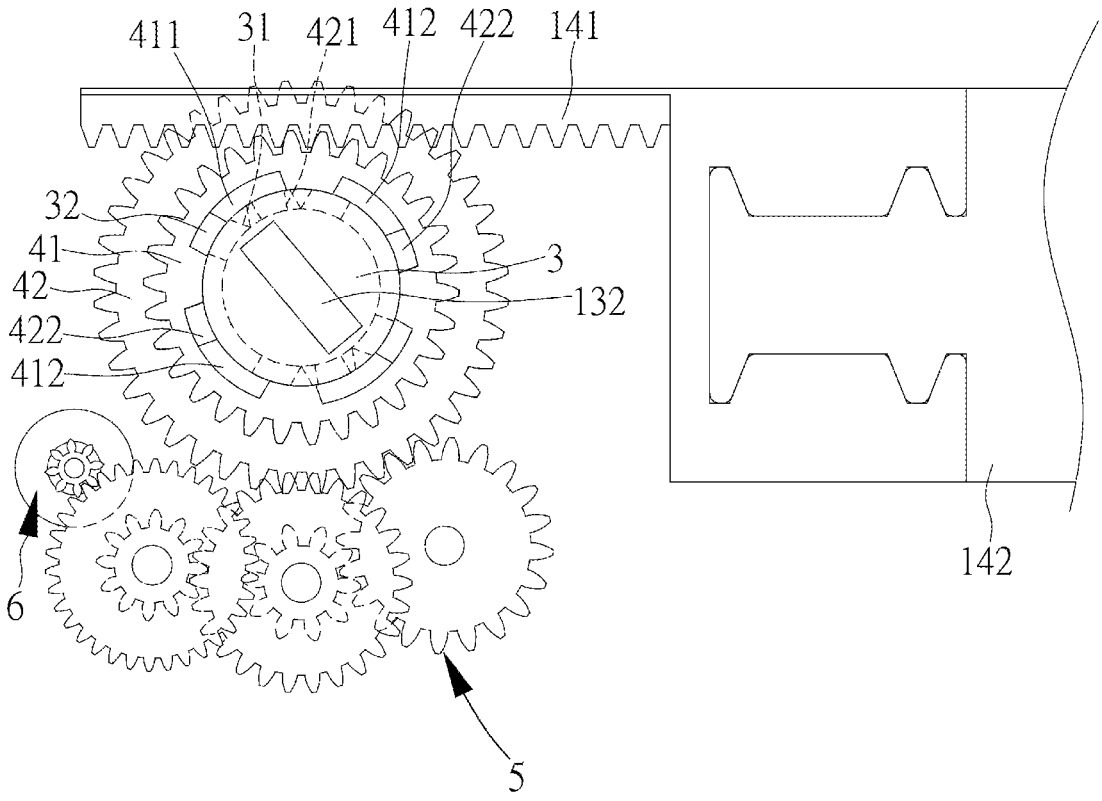
FIG. 9 is a continuous schematic view of FIG. 7.
Figure 10:
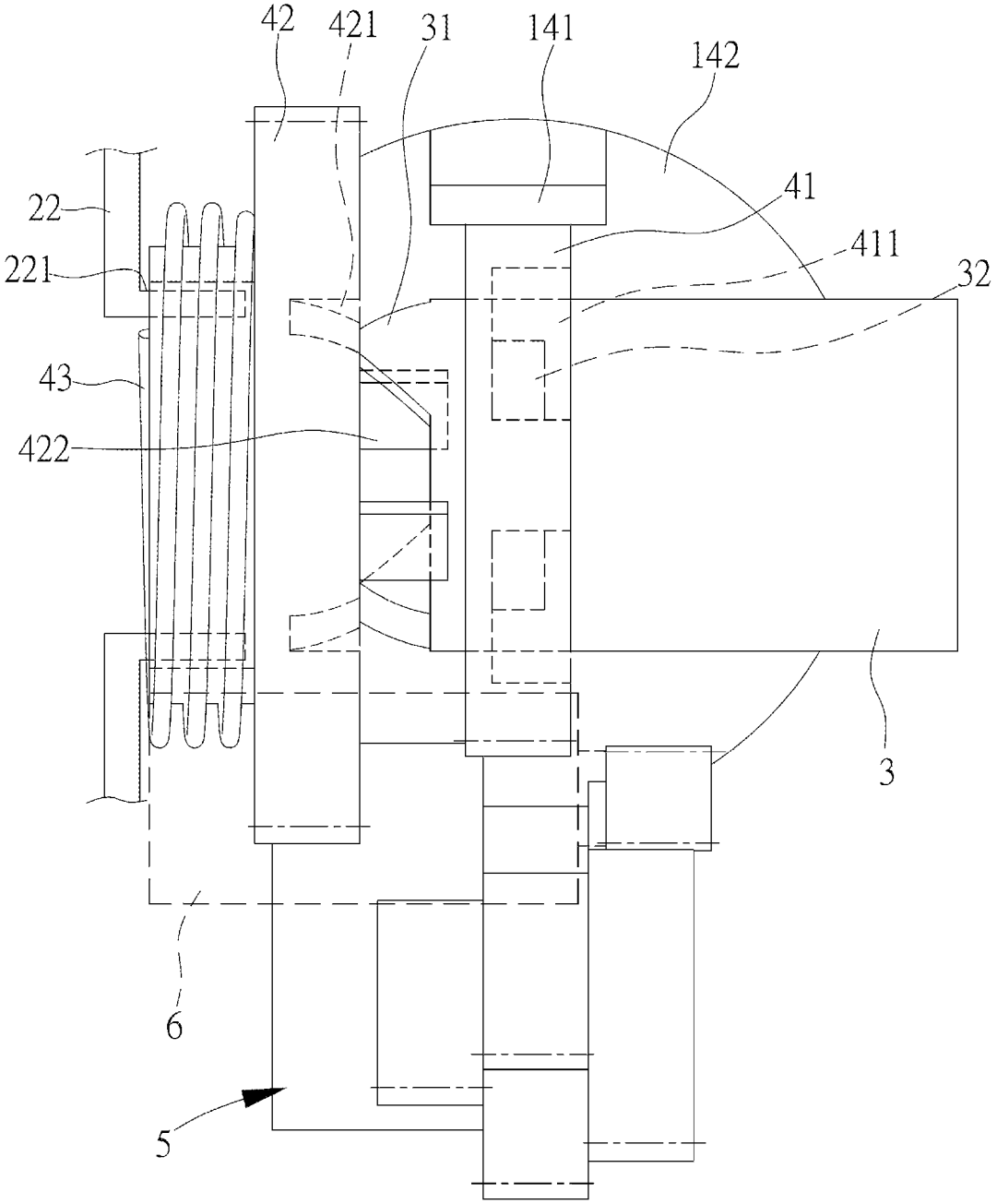
FIG. 10 is a side schematic view of FIG. 9.
Figure 11:
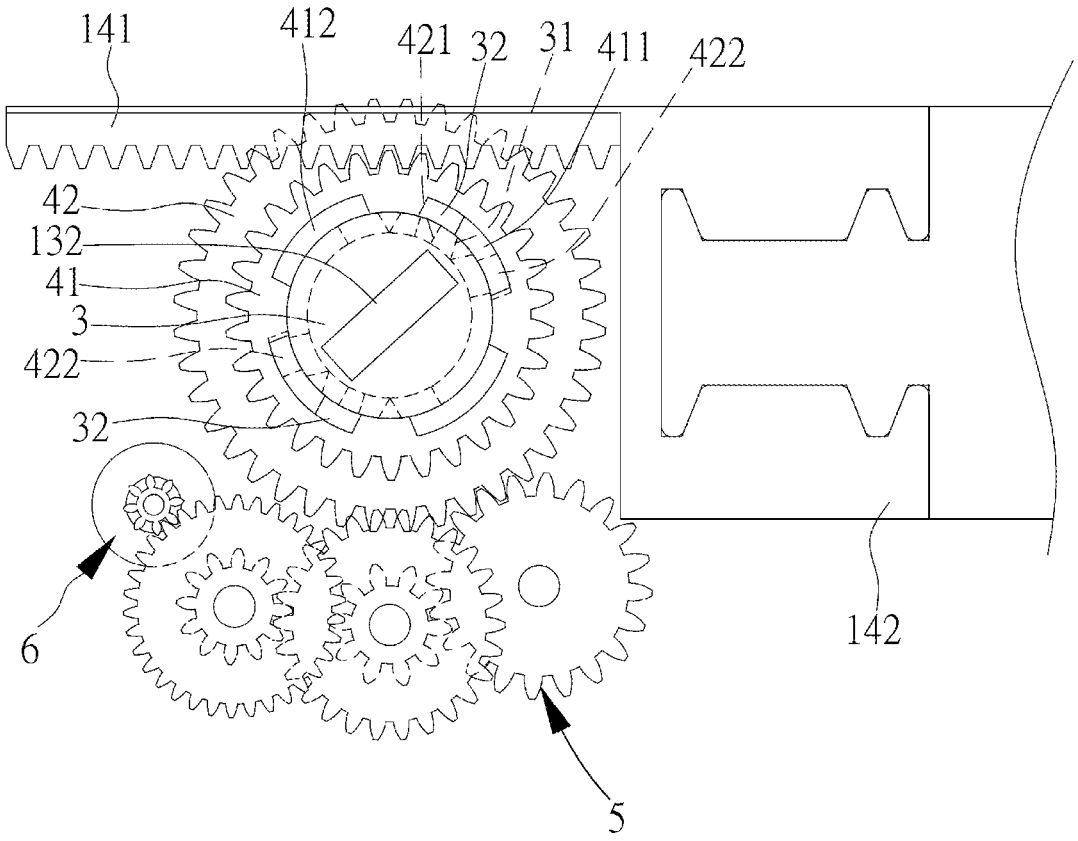
FIG. 11 is a continuous schematic view of FIG. 9.
Figure 12:
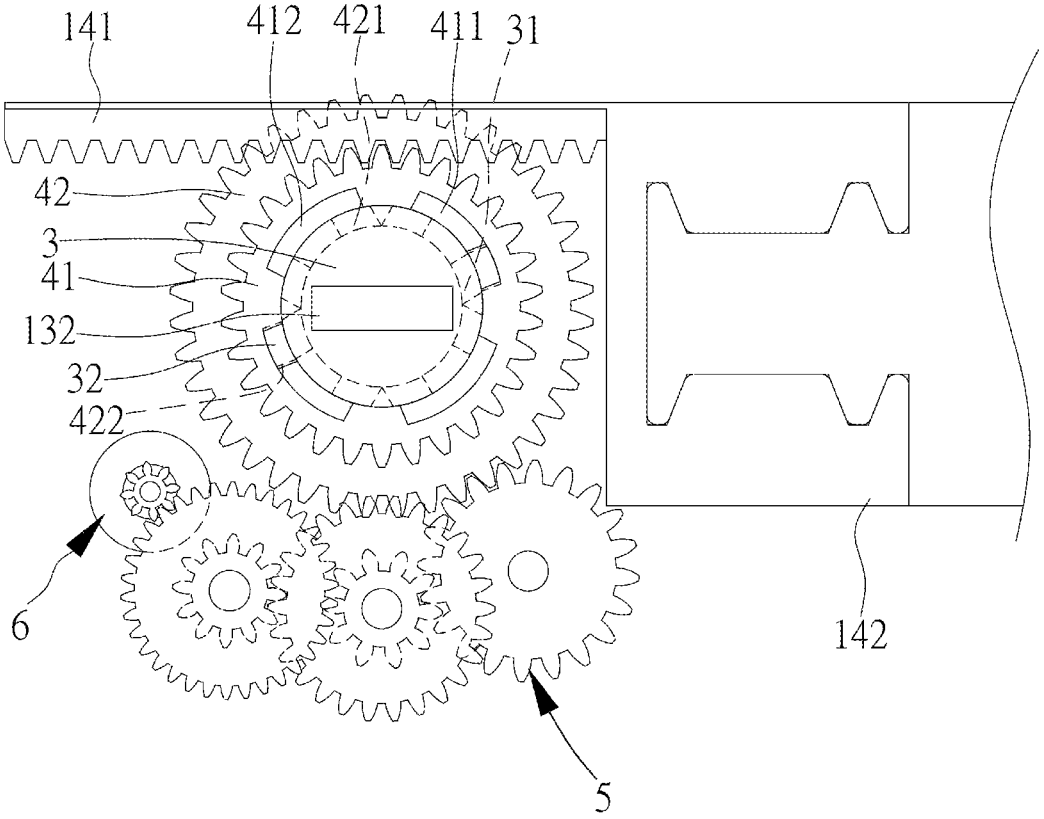
FIG. 12 is a continuous schematic view of FIG. 11.

When the lock 1 for door is in the locked state as shown in FIG. 7, if a key is inserted into the key control member 131 from outside of the door, the rotary handle 132 is able to be driven to drive the upper rotor member 3 to rotate anticlockwise to the position as shown in FIG. 9. During this process, the protruding wings 32 of the upper rotor member 3 are moved from one end of the first groove 411 to the other end of the first groove 411 without linking the linking gear 41 to move. Meanwhile, the top butting elements 31 of the upper rotor member 3 slid in the corresponding engaging grooves 421 respectively and are gradually pushing the clutch gear 42 to move backwards and compressing the resilient element 43 as shown in FIG. 10 until the top butting elements 31 are separated from the engaging grooves 421 respectively and pressed against the end face of the clutch gear 42. At this time, the protruding lug element 422 of the clutch gear 42 are separated from the second grooves 412 respectively until the clutch gear 42 is completely disengaged and separated from the linking gear 41, so that the linking gear 41 is no longer moved by the clutch gear 42 and the deceleration gear set 5. When the upper rotor member 3 is continuously rotated anticlockwise to a state as shown in FIG. 11, the protruding wings 32 of the upper rotor member 3 drive the linking gear 41 to rotate so as to drive the lock bolt 14 to an unlocked position. At this time, an operator may turn the rotary handle 132 to a position as shown in FIG. 12 to complete the manual unlocking operation. Finally, the clutch gear 42 can be electrically controlled by the motor 6 or driven by the rotating member 15 to rotate to the position corresponding to the engaging grooves 421, and thus the top butting elements 31 are engaged in the engaging grooves 421 respectively through the pushing of the resilient element 43, thereby the electrical locking state (electric mode) can be restored.

Through the configuration and design of the clutch transmission set 4 of the locking latch assembly 2, the lock 1 for door can be switched smoothly between the electric mode and the manual mode. However, each component of the clutch transmission set 4 is remained simple in structure that simplifies the overall structure of the lock 1 too while it is simpler in assembling and more cost effective in material cost and assembling cost.

What is claimed is:

1. A lock for a door, comprising:

an outer case;

an inner case connected with said outer case;

a lock latch assembly arranged between said inner case and said outer case, wherein said lock latch assembly comprises a first latch shell, a second latch shell butted with said first latch shell, an upper rotor member arranged between said first latch shell and said second latch shell, a clutch transmission set, a deceleration gear set, and a motor, wherein said upper rotor member has a cylindrical shape and is pivotally arranged in said first latch shell, wherein two top butting elements are protrudedly formed on one end face of said upper rotor member, two protruding wings are respectively formed on opposite sides of said upper rotor member, and a through hole is axially penetrated through said upper rotor member, wherein said clutch transmission set comprises a linking gear pivotally sleeved on said upper rotor member, a clutch gear pivotedly arranged on said second latch shell, and at least a resilient element arranged between said clutch gear and said second latch shell, wherein said linking gear has two first grooves intervally formed in opposite directions at an inner circular surface of said linking gear, and two second grooves intervally formed in opposite directions at said inner circular surface of said linking gear in such a manner that each of said two grooves is positioned between two of said second grooves correspondingly, wherein said two first grooves are arranged for said protruding wings to engage therewith respectively, while allowing said two protruding wings to rotate in said two first grooves respectively for a predetermined angle, wherein said clutch gear is arranged coaxially adjacent to said linking gear, wherein said inner circular surface of said clutch gear forms two opposing engaging grooves correspondingly and two opposing protruding lug elements protruded into one end face of said linking gear, such that said engaging grooves are configured for said top butting elements being engaged therein respectively while said two protruding lug elements are engaged in said two second grooves respectively, wherein each of said protruding lug elements is allowed to rotate at a predetermined angle in said corresponding second groove, wherein said deceleration gear set is meshed with said clutch gear and driven by said motor to rotate said clutch gear;

a lock rotor arranged between said outer case and said lock latch assembly, wherein said lock rotor comprises a key control member arranged in said outer case and a rotary handle extended from said key control member, wherein said rotary handle is arranged to pass through said through hole of said upper rotor member to rotate said upper rotor member;

a lock bolt linked with said lock latch assembly, wherein said lock bolt comprises a rack meshed with said linking gear and a bolt lock body extended from said rack, wherein said rack is configured to driven by said linking gear to link said bolt lock part to slide with respect to said bolt case; and a rotating member pivotally provided in said inner case, wherein said rotating member is connected with said rotary handle, wherein when said rotating member is rotated, said rotary handle is driven to rotate, wherein when said deceleration gear set is driven by said motor to drive said clutch gear to rotate, said clutch gear drives said linking gear to rotate by said protruding lug elements and then move said rack and said bolt lock body, wherein when said rotary handle is manually driven to rotate, said upper rotor member is rotated with said rotary handle and said top butting elements push said clutch gear for an axial displacement to compress said resilient element, such that said protruding lug elements are detached and separated from said second grooves respectively, and that said upper rotor member continues to rotate and said protruding wings drive said linking gear to rotate to move said rack and said bolt lock body.

2. The lock, as recited in claim 1, wherein said outer case has an outer threaded portion, and said inner case has an inner threaded portion configured to be connected with said outer threaded portion by screwing so as to assemble said outer case with said inner case.

* * * * *